US005540640A

United States Patent [19]

Povilaitis

[11] Patent Number: 5,540,640

[45] Date of Patent: Jul. 30, 1996

[54] DELTOID MUSCLE EXERCISE DEVICE

[76] Inventor: Darius A. Povilaitis, 14911 127th St., Lemont, Ill. 60439-6466

[21] Appl. No.: 310,664

[22] Filed: Sep. 22, 1994

[51] Int. Cl.[6] ..... A63B 21/06

[52] U.S. Cl. ..... 482/108; 482/106; 482/139

[58] Field of Search ..... 482/93, 106, 108, 482/92, 139, 148

[56] References Cited

U.S. PATENT DOCUMENTS

| | | | |
|---|---|---|---|
| 4,345,756 | 8/1982 | Hoagland | 482/108 |
| 4,607,840 | 8/1986 | Harper | 482/139 |
| 4,865,314 | 9/1989 | Carter | 482/106 |
| 4,943,052 | 7/1990 | Powers | 482/108 |
| 4,986,536 | 1/1991 | Zane | 482/106 |
| 5,096,190 | 3/1992 | Montgomery . | |
| 5,171,198 | 12/1992 | Jones . | |

*Primary Examiner*—Stephen R. Crow
*Attorney, Agent, or Firm*—Marshall, O'Toole, Gerstein, Murray & Borun

[57] ABSTRACT

In order to maximize the benefit from exercise by isolating a muscle to be developed, a deltoid muscle exercise device is disclosed. The device includes a base for supporting it on a generally flat surface, a frame integral with the base and extending generally upwardly therefrom, a grip integral with the frame at a point generally remote from the base, and an arm rest integral with the frame at a point generally intermediate the base and the grip. With these features, the deltoid muscle exercise device also is adapted to support free weights at a point generally closer to the base than to the grip.

23 Claims, 3 Drawing Sheets

DELTOID MUSCLE EXERCISE DEVICE

FIELD OF THE INVENTION

The present invention is generally directed to an exercise apparatus and, more particularly, a device adapted to isolate and exercise a deltoid muscle.

BACKGROUND OF THE INVENTION

In recent years, there has been a tremendous growth in interest in the field of weight training. This interest has resulted in the development of a large number of different types of specialized apparatus and machines that are designed to exercise a specific muscle or muscle group. In the case of specialized exercise machines, it is known that they are usually complex and, thus, costly.

For the individual interested in weight training, the specialized exercise machines are usually sufficiently costly to preclude personal ownership with the exception of those who have large amounts of discretionary income. This is especially true of any of the exercise machines that are sufficiently developed as to be capable of truly isolating a particular muscle or muscle group as opposed to the so-called "all-purpose" machines that are advertised as being capable of exercising substantially all muscles or muscle groups by various rearrangements of the operating components. Since the serious weight training enthusiast knows of these limitations, and cannot afford to own a plurality of specialized exercise machines, the use of traditional "free weights" is usually preferred.

Unfortunately, the specialized exercise machines are usually viewed as being more efficient in exercising specific muscles. For instance, particularly difficult muscles to develop are the deltoid muscles on the tops of the shoulders wherein, in the case of "free weights," such muscles are conventionally exercised by grasping dumbbells in each hand and laterally raising them upwardly through a lateral shoulder abduction movement with the arms bent or extended at the elbows. As is well known to weight training enthusiasts, this is a difficult exercise to perform with dumbbells in a steady, controlled manner.

In this connection, a steady, controlled lateral abductive movement through a relatively large range of motion is known to be necessary in order to successfully exercise the deltoids. It would, thus, be highly desirable to be able to use free weights, but in a different manner from the conventional technique, e.g., on a static, portable exercise device or apparatus, that would make it possible to maximize muscular benefit to the deltoid muscles while making it difficult, if not impossible, to cause injury. If this could be achieved, the weight training enthusiast could achieve the objective of developing the deltoids without the need for access to any specialized exercise machines.

The present invention is directed to overcoming one or more of the foregoing problems while achieving one or more of the resulting objects.

SUMMARY OF THE INVENTION

It is, therefore, a principal object of the present invention to provide a deltoid muscle exercise device. It is a further object of the present invention to provide such a device that is very simple in nature and adapted for use with free weights. It is an additional object of the present invention to provide a portable device for exercising deltoids.

Accordingly, the present invention is directed to a deltoid muscle exercise device, including base means for supporting the device on a generally flat surface and frame means integral with the base means and extending generally upwardly therefrom. The exercise device also includes grip means which is integral with the frame means at a point that is located generally remote from the base means. Still additionally, the deltoid muscle exercise device includes arm rest means integral with the frame means at a point generally intermediate the base means and grip means and means for supporting free weights at a point generally closer to the base means than to the grip means.

Preferably, the exercise device is such that the base means, frame means, and grip means are each formed of generally tubular steel. It is also advantageous for the arm rest means to be formed of a curved steel plate extending between opposed uprights of the frame means. Still additionally, the free weights supporting means is preferably integral with and extends generally perpendicular to the arm rest means.

In the exemplary embodiment, the device includes shoulder rest means which is operatively associated with the grip means for sliding movement relative thereto. The shoulder rest means advantageously comprises a cushioning pad fully surrounding a portion of a crossbar defining the grip means at a point which is located opposite the base means. In this connection, the cushioning pad will be understood to be of a lesser length than the crossbar for sliding movement on the crossbar from one end to the other.

In a most highly preferred embodiment, the exercise device is such that the base means, frame means, and grip means are each formed of a single steel tube having a plurality of bends therein. It is advantageous for the base means to comprise a pair of spaced apart legs defined by a lowermost pair of the bends in the steel tube. In the most highly preferred embodiment, the free weights supporting means is also formed of a steel tube integrally carried by the curved steel plate so as to extend between the opposed uprights of the frame means.

More specifically, the curved steel plate extends between the opposed uprights of the frame means at a point well below the grip means to define a rather large opening for the upper arm so as to avoid any possible direct contact of any portion of the device with the deltoid muscles during exercise.

In an alternative embodiment, the device includes a pair of inwardly facing channels on the frame means portion of the steel tube in which the curved steel plate comprising the arm rest means is disposed. The channels are then advantageously sized to accommodate confined sliding movement of the curved steel plate relative to the frame means portion of the steel tube, and, with this construction, the free weights supporting means then preferably comprises a second curved steel plate outwardly of the first and integral with the frame means portion of the steel tube. In this alternative embodiment, the device may advantageously include ball bearings disposed between the curved steel plate of the arm rest means and the curved steel plate of the free weights supporting means.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
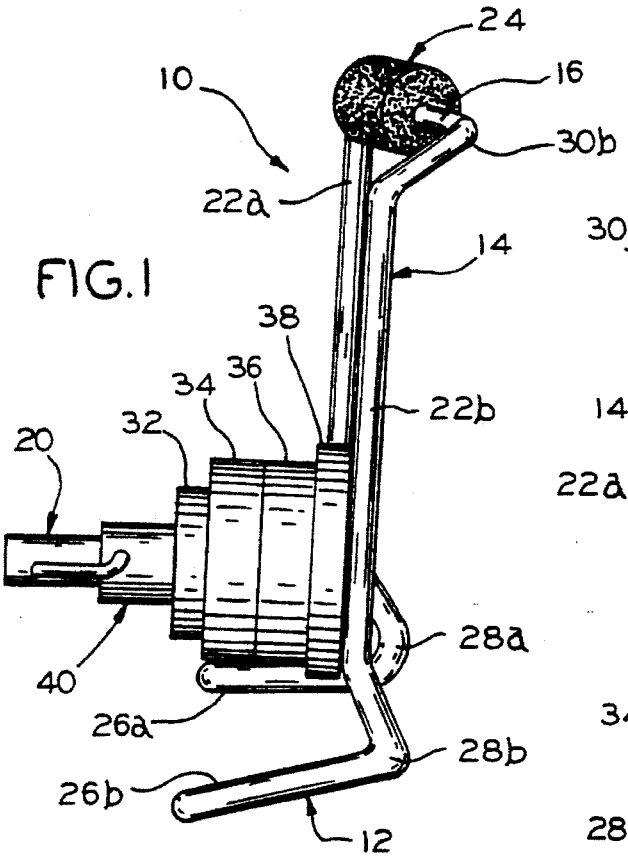
FIG. 1 is a side elevational view of a deltoid muscle exercise device according to the present invention.

In the illustrations given, and with reference first to FIG. 1, the reference numeral 10 designates generally a deltoid muscle exercise device in accordance with the present invention. The device 10 will be seen to include base means generally designated 12 for supporting the device 10 on a generally flat surface such as a floor, and frame means generally designated 14 which is integral with the base means 12 at a lower end of the device 10 and extends generally upwardly therefrom. The device 10 also includes grip means generally designated 16 which is integral with the frame means 14 at an upper end of the device 10 and generally remote from the base means 12. With these features, the deltoid muscle exercise device 10 also includes arm rest means generally designated 18 (see FIG. 3) and means for supporting free weights generally designated 20 (see FIG. 2).

Figure 2:
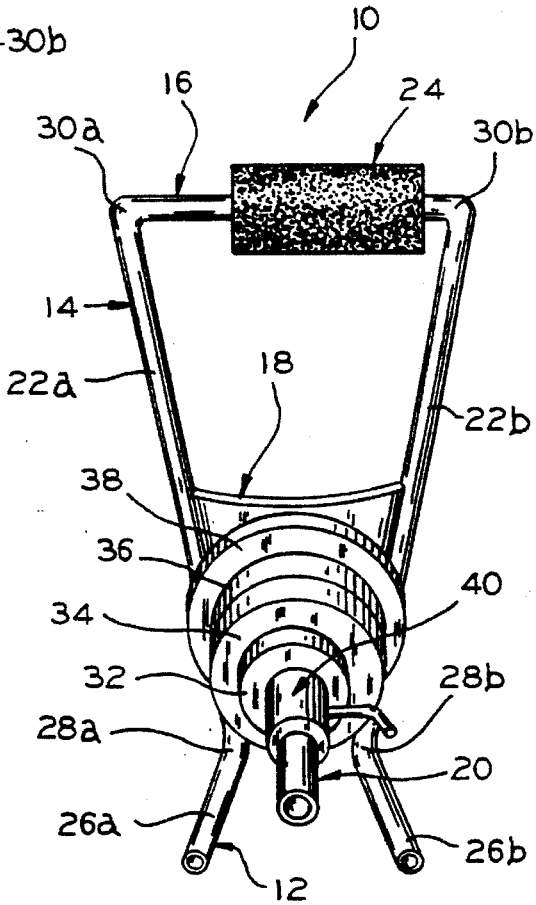
FIG. 2 is a front elevational view of the deltoid muscle exercise device illustrated in FIG. 1.
Figure 3:
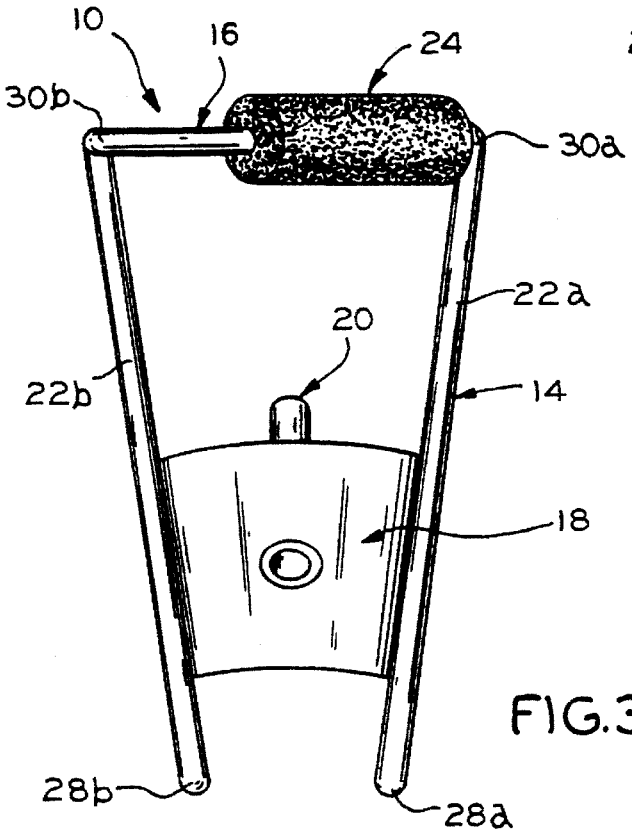
FIG. 3 is a rear elevational view of the deltoid muscle exercise device illustrated in FIG. 1.

As shown in FIGS. 1–3, the arm rest means 18 is integral with the frame means 14 at a point generally intermediate the base means 12 and grip means 16 and the means for supporting free weights generally designated 20 (see FIG. 2) is positioned at a point generally closer to the base means 12 than to the grip means 16.

Referring to FIGS. 1–5, the deltoid muscle exercise device 10 is such that the base means 12, frame means 14, and grip means 16 are each preferably formed of generally tubular steel. It will aim be seen that the arm rest means 18 is preferably formed of a curved steel plate so as to extend between opposed uprights 22*a* and 22*b* of the frame means 14, and the free weights supporting means 20 is integral with and extends generally perpendicular to the curved steel plate 18. As is also shown in FIGS. 1–5, the deltoid muscle exercise device 10 includes shoulder rest means generally designated 24 operatively associated with the grip means 16 for sliding movement relative thereto.

Figure 8:
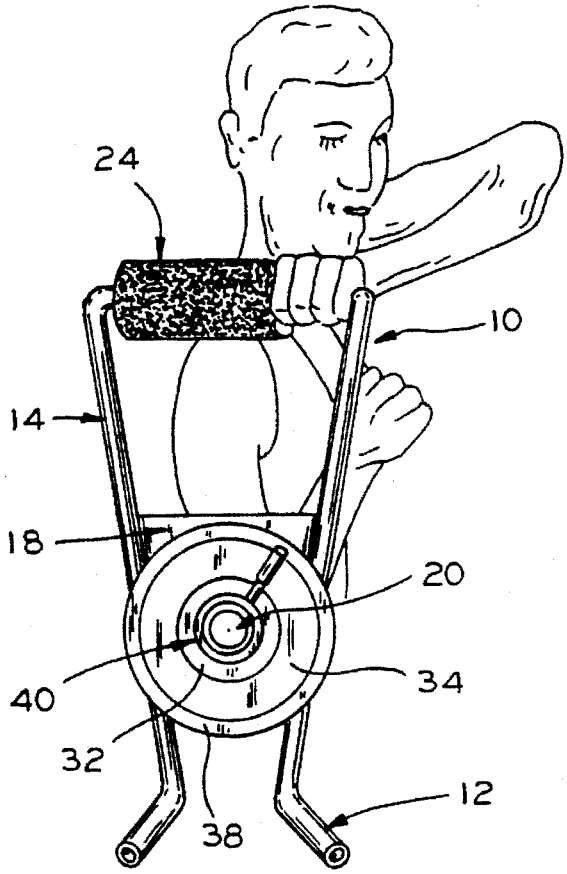
FIG. 8 is a side elevational view of a person using the deltoid muscle exercise device of FIG. 1.

As shown in FIGS. 2 and 8, the curved steel plate 18 extends between the opposed uprights 22*a* and 22*b* of the frame means 14 at a point well below the grip means 16 to define a rather large opening for the upper arm so as to avoid any possible direct contact of any portion of the device 10 with the deltoid muscles during exercise.

In the illustrated embodiment, the base means 12, frame means 14, and grip means 16 are each most advantageously formed of a single steel tube having a plurality of bends therein. It will be seen, in particular, that the base means 12 may advantageously comprise a pair of spaced apart legs 26*a* and 26*b* defined by a lowermost pair of bends 28*a* and 28*b* formed in the steel tube. As for the grip means 16, it will preferably comprises a bar opposite the base means 12 or legs 26*a* and 26*b* which is defined by an uppermost pair of bends 30*a* and 30*b* in the steel tube.

Figure 4:
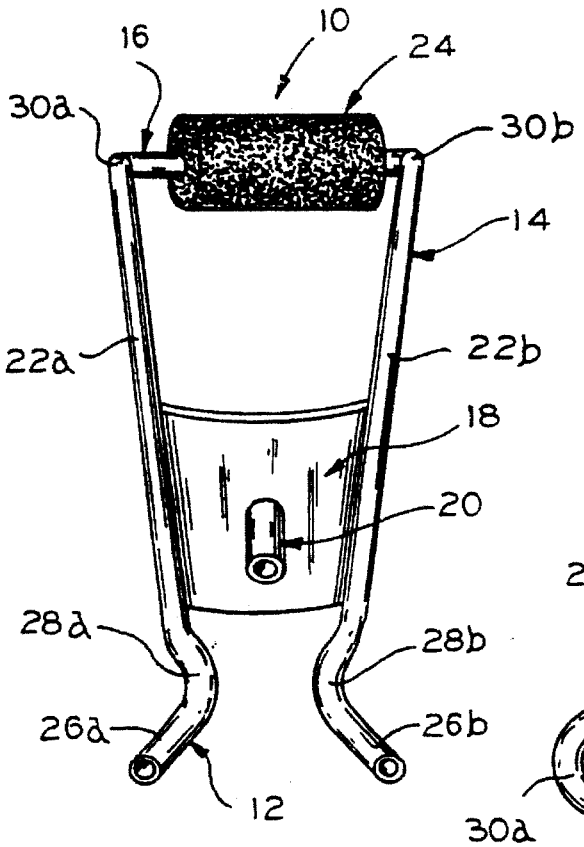
FIG. 4 is a front elevational view similar to FIG. 2 but with the free weights removed.
Figure 5:
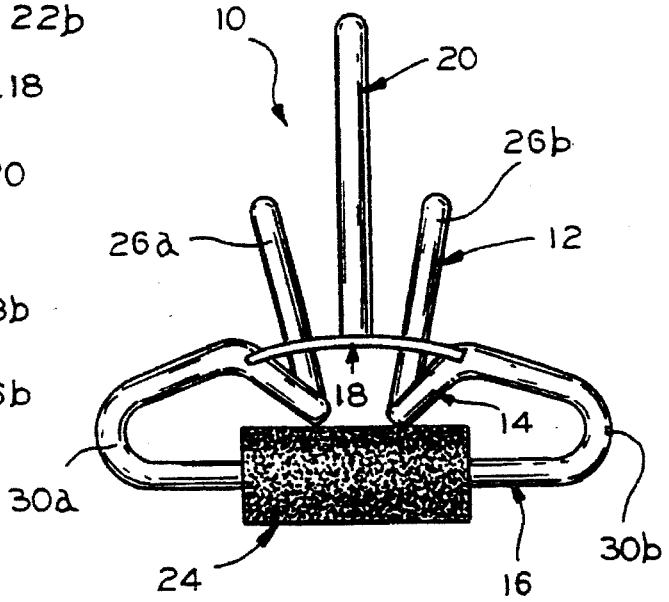
FIG. 5 is a top plan view of the deltoid muscle exercise device illustrated in FIG. 4.

As will be appreciated by referring to FIG. 4, the free weights supporting means 20 advantageously comprises a steel tube which is integrally associated with the curved plate 18 as by welding or the like (see, also, FIG. 3). It will also be seen from FIGS. 1–5 that the shoulder rest means 24 preferably comprises a cushioning pad for the shoulder and/or neck region which preferably completely surrounds a portion of the crossbar 16 in relative slidable relation thereto so as to permit another portion of the crossbar 16 to be gripped, as will be described in detail hereinafter. As best shown in FIGS. 1 and 2, the deltoid muscle exercise device 10 is also formed such that the steel tube 20, which is remote from the crossbar 16 and the cushioning pad 24, is sized to receive a plurality of free weights such as 32, 34, 36, 38.

Still referring to FIGS. 1 and 2, the plurality of free weights such as 32, 34, 36, 38 carried on the deltoid muscle exercise device 10 from time-to-time are preferably retained on the steel tube 20 by a conventional free weights locking collar 40. It will also be seen that the steel tube 20 is preferably slightly upwardly inclined (FIG. 1) when the device 10 is placed on a flat, horizontal surface to facilitate exchanging free weights and retaining them in position on the device 10 until the locking collar 40 has been placed in position and securely tightened. Further, the device 10 is preferably formed with the uprights 22*a* and 22*b* slightly upwardly and rearwardly inclined relative to the legs 26*a* and 26*b* to provide balance for the device 10 sit stably on a flat, horizontal surface with free weights 32, 34, 36, 38 thereon.

Figure 9:
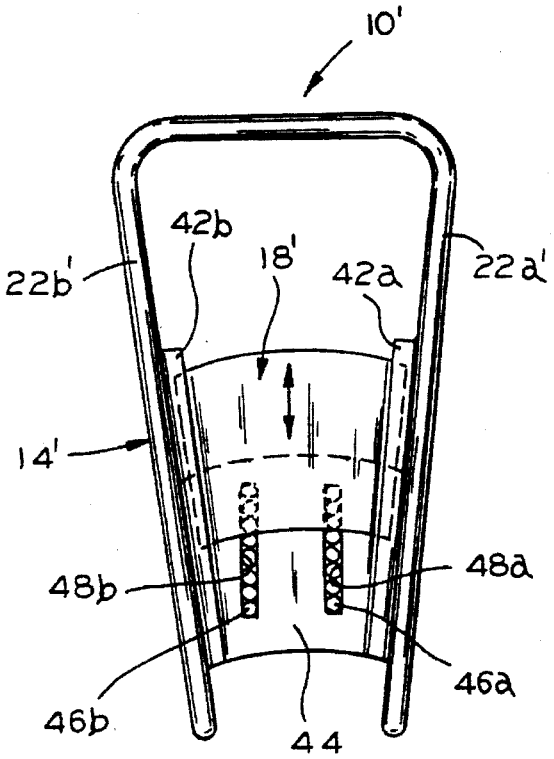
FIG. 9 is a rear elevational view of another embodiment of a deltoid muscle exercise device.

Referring now to FIG. 9, and as will be readily apparent, the deltoid muscle exercise device 10' is similar in many respects to the deltoid muscle exercise device 10 described hereinabove. It differs, however, primarily in that it includes a pair of inwardly facing channels 42*a* and 42*b* on the frame means portion 14', i.e., the opposed uprights 22*a*' and 22*b*' of the steel tube, in which the curved steel plate 18' comprising the arm rest means is disposed. In this embodiment, the free weights supporting means comprises a second curved steel plate 44 integral with the frame means portion 14' of the steel tube so as to be in fixed relation relative thereto.

With this construction, the second curved steel plate 44 will be understood to have an outwardly projecting steel tube such as 20 (not shown) to receive and support free weights such as 32, 34, 36, 38. This will, of course, be on the side of the curved steel plate 44 opposite that shown in FIG. 9. However, since it will be identical in all respects to the arrangement as shown in FIGS. 1–5, there is no need for this detail to be illustrated in order to understand this alternative embodiment.

Still referring to FIG. 9, the channels 42*a* and 42*b* are sized to accommodate confined sliding movement of the curved steel plate 18' relative to the frame means portion 14' of the steel tube. It will also be seen that the deltoid muscle exercise device 10' preferably includes ball bearings as at 46*a* and 46*b* in raceways as at 48*a* and 48*b* formed in the curved steel plate 44. As will be appreciated, the ball bearings as at 46*a* and 46*b* facilitate sliding movement of the curved steel plate 18' relative to the curved plate 44 in the channels 42*a* and 42*b*.

Figure 6:
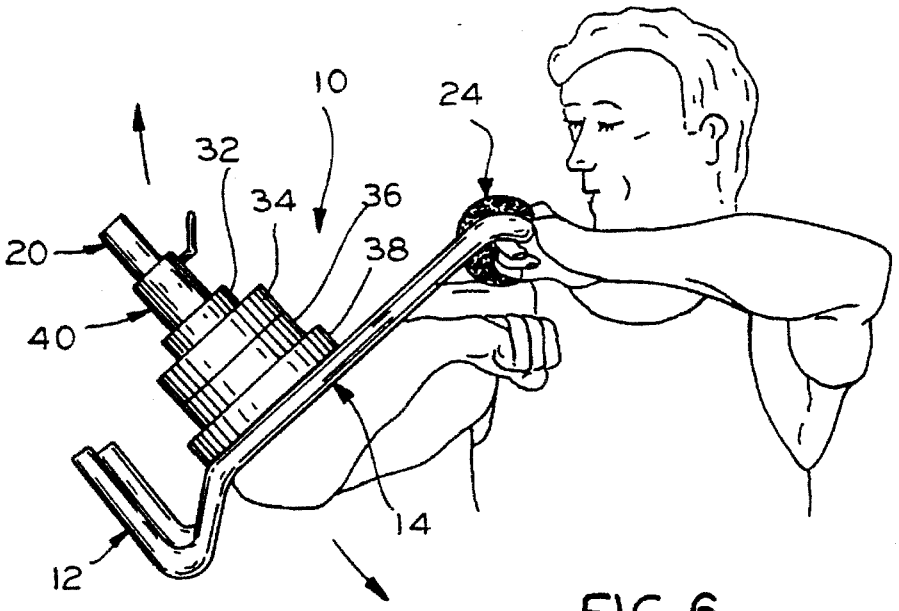
FIG. 6 is a front elevational view of a person using the deltoid muscle exercise device of FIG. 1.
Figure 7:
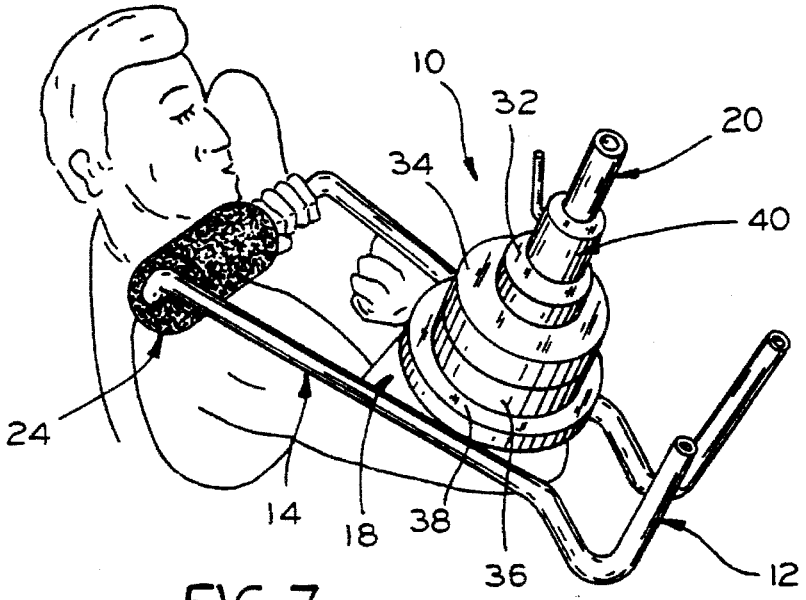
FIG. 7 is a rear perspective view of a person using the deltoid muscle exercise device of FIG. 1.

Referring to FIGS. 6–8 and comparing the positions of the deltoid muscle exercise device 10 or 10', it will be understood and appreciated that exercise is performed with the device 10 or 10' by gripping the crossbar 16 on one side of the cushioning pad 24 with the hand opposite the deltoid muscles to be exercised. The device 10 or 10' is then lifted in order to position the cushioning pad 24 atop the shoulder and against the neck such that the cushioning pad 24 serves as a pivot point, and the device 10 or 10' can then undergo free rotational movement about the crossbar 16 as it rests against the shoulder and neck in "bird wing flapping motion" style. When initiating the exercise, the upper arm is tight against the body as shown in FIG. 8, with the elbow resting generally under the curved steel plate 18 or 18', and the "bird wing flapping motion" is performed with one arm while the hand of the opposite arm supports the device 10 or 10' with the crossbar 16 acting as a pivot or hinge.

As will be appreciated, the motion of the device 10 or 10' will not necessarily be a perfect are when the arm performs the "bird wing flapping motion." This means that there will be some relative sliding motion between the elbow and the curved steel plate 18 in the embodiment of the device designated by the reference numeral 10, i.e., the embodiment in which the curved steel plate is fixed as by welding or the like relative to the remainder of the device 10. With the device 10', the relative sliding motion between the elbow and the curved steel plate 18' is eliminated due to the unique construction.

More specifically, the curved steel plate 18' is able to remain fixed relative to the elbow since it can undergo sliding movement relative to the remainder of the device 10' due to the use of the channels **42*a* and 42*b* and the ball bearings 46*a* and 46*b***.

With either of the devices 10 and 10', an ideal apparatus has been provided for specifically building the anterior, medial, and posterior deltoid heads comprising the deltoid muscle. The weight provided by the free weights such as 32, 34, 36, 38 is placed slightly above the elbow area towards the deltoid muscle which causes the deltoid muscle to do most all of the work in lifting the weight upwards when the arm is forced to undergo the "bird wing flapping motion." When dumbbells are used to perform the "bird wing flapping motion", considerable stress is placed on the wrist, hand, and elbow joints, as well as the forearm muscles, unlike the present invention.

By reason of this fact, the forearm muscles, elbow joints, hand, and wrist are apt to become fatigued when using dumbbells long before the deltoid muscles become fatigued. Thus, the conventional use of free weights with dumbbells results in the deltoid muscles receiving less than a maximum isolation workout, but the key to building specific muscles larger and stronger is to be able to isolate the chosen muscles during a weight-lifting routine and to place the maximum amount of stress on the particular muscle during the workout. Especially in the case of the deltoid muscles, repetition and heavy stress must be placed upon them in order for them to be the desired degree of growth and strength development.

With the present invention, the deltoid muscles are isolated while using the heaviest weights they can bear. This results in optimal exercise for these muscles. Because of the isolation of the anterior, medial, and posterior heads of the deltoid muscle, development can be achieved in several ways.

For anterior deltoid muscle focus, the deltoid muscle exercise device 10 or 10' is used by imparting the "bird wing flapping motion" with the elbow pointed out ahead of the body so that the anterior deltoid head does most of the work. For medial deltoid muscle development, the deltoid muscle exercise device 10 or 10' is used such that the "bird wing flapping motion" is done with the elbow pointed out towards the side of the body and slightly forwardly such that the me, dial deltoid head does most of the work. For posterior deltoid muscle focus, the deltoid muscle exercise device 10 or 10' is used such that the "bird wing flapping motion" is done with the elbow pointed out slightly towards the rear of the body such that the posterior deltoid head does most of the work.

For the first time, the present invention provides a unique personal exercise device specifically designed to develop the deltoid muscles which is highly effective for its intended purpose while being inexpensive and very simple to use.

While in the foregoing them have been set forth preferred embodiments of the invention, it will be appreciated that the details herein given may be varied by those skilled in the art without departing from the true spirit and scope of the appended claims.

I claim:

1. A deltoid muscle exercise device, comprising:

shoulder rest means disposed as to be positioned atop a shoulder during exercise, said shoulder rest means serving as a pivot point for said device during a lifting and lowering arm motion therewith;

grip means integrally associated with said shoulder rest means for gripping said device during exercise, said grip means causing said device to be stabilized during said lifting and lowering arm motion;

arm rest means integrally associated with said shoulder rest means at a point spaced therefrom, said arm rest means being positioned over an elbow region during said lifting and lower arm motion; and means integrally associated with said arm rest means for supporting free weights at a point generally horizontally adjacent said elbow region.

2. The deltoid muscle exercise device of claim 1 wherein at least said grip means is formed of generally tubular steel to be gripped by a hand during exercise.

3. The deltoid muscle exercise device of claim 1 wherein said arm rest means is formed of a curved steel plate to be positioned on an elbow during exercise.

4. The deltoid muscle exercise device of claim 3 wherein said curved steel plate is spaced below said grip means in a manner defining an opening therebetween.

5. The deltoid muscle exercise device of claim 1 wherein said free weights supporting means extends generally perpendicular to said arm rest means.

6. The deltoid muscle exercise device of claim 1 wherein said shoulder rest means comprises a cushioning pad surrounding said grip means for sliding movement relative thereto.

7. A deltoid muscle exercise device, comprising:

base means for supporting said device on a generally flat surface;

frame means integral with said base means and extending generally upwardly therefrom;

grip means integral with said frame means at a point generally remote from said base means;

arm rest means integral with said frame means at a point generally intermediate said base means and grip means;

means for supporting free weights at a point generally closer to said base means than to said grip means; and at least said base means, frame means, and grip means each being formed of generally tubular material and said arm rest means being formed of a plate extending between opposed uprights of said frame means.

8. The deltoid muscle exercise device of claim 7 wherein said free weights supporting means is integral with and extends generally perpendicular to said plate.

9. The deltoid muscle exercise device of claim 7 including shoulder rest means comprises a cushioning pad surrounding said grip means for sliding movement relative thereto.

10. The deltoid muscle exercise device of claim 7 wherein said base means, frame means, and grip means are each formed from a single steel robe having a plurality of bends therein.

11. The deltoid muscle exercise device of claim 10 wherein said base means comprises a pair of spaced apart legs defined by a lowermost pair of said bends in said steel tube.

12. The deltoid muscle exercise device of claim 10 wherein said grip means comprises a crossbar opposite said base means defined by an uppermost pair of said bends in said steel tube.

13. The deltoid muscle exercise device of claim 12 wherein said arm rest means is spaced below said grip means to define an opening between said opposed uprights of said frame means.

14. A deltoid muscle exercise device, comprising:

base means for supporting said device on a generally flat surface;

frame means integral with said base means and extending generally upwardly therefrom;

grip means integral with said frame means at a point generally remote from said base means;

arm rest means integral with said frame means at a point generally intermediate said base means and grip means;

means for supporting free weights at a point generally closer to said base means than to said grip means;

at least said base means, frame means, and grip means each being formed of generally tubular steel and said arm rest means being formed of a curved steel plate extending between opposed uprights of said frame means;

said free weights supporting means being integral with said opposed uprights of said frame means and extending generally perpendicular to the plane defined thereby; and shoulder rest means comprises a cushioning pad surrounding said grip means for sliding movement relative thereto, said base means, frame means and grip means each being formed of a single steel tube having a plurality of bends therein.

15. The deltoid muscle exercise device of claim 14 wherein said base means comprises a pair of spaced apart legs defined by a lowermost pair of said bends in said steel tube.

16. The deltoid muscle exercise device of claim 15 wherein said grip means comprises a crossbar opposite said base means defined by an uppermost pair of said bends in said steel tube.

17. The deltoid muscle exercise device of claim 16 wherein said free weight supporting means comprises a steel tube on a second curved steel plate integral with said frame means portion of said steel tube.

18. The deltoid muscle exercise device of claim 17 wherein said shoulder rest means comprises a cushioning pad surrounding a portion of said crossbar in relative slidable relation thereto.

19. The deltoid muscle exercise device of claim 18 wherein said arm rest means is spaced below said grip means to define an opening between said opposed uprights of said frame means.

20. The deltoid muscle exercise device of claim 14 including a pair of inwardly facing channels on said frame means portion of said steel tube in which said curved steel plate is disposed.

21. The deltoid muscle exercise device of claim 20 wherein said channels are sized to accommodate confined sliding movement of said curved steel plate relative to said frame means portion of said steel tube.

22. The deltoid muscle exercise device of claim 21 wherein said free weight supporting means comprises a second steel curved plate integral with said frame means portion of said steel tube.

23. The deltoid muscle exercise device of claim 22 including ball bearings disposed between said curved steel plate of said arm rest means and said curved steel plate of said free weight supporting means.

* * * * *

UNITED STATES PATENT AND TRADEMARK OFFICE

CERTIFICATE OF CORRECTION

PATENT NO. : 5,540,640

DATED : July 30, 1996

INVENTOR(S) : POVILAITIS, Darius

It is certified that error appears in the above-identified patent and that said Letters Patent is hereby corrected as shown below:

column 3, line 48, replace "aim" with --also--; and column 7, line 11, replace "robe" with --tube--.

Signed and Sealed this

Twenty-ninth Day of October 1996

*Attest:*

BRUCE LEHMAN

*Attesting Officer*

*Commissioner of Patents and Trademarks*